US006309425B1

(12) United States Patent
Murphy

(10) Patent No.: US 6,309,425 B1
(45) Date of Patent: Oct. 30, 2001

(54) CLEANING COMPOSITION AND METHOD FOR USING THE SAME

(75) Inventor: Dennis Stephen Murphy, Leonia, NJ (US)

(73) Assignee: Unilever Home & Personal Care, USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/416,124

(22) Filed: Oct. 12, 1999

(51) Int. Cl.[7] ..... D06F 43/00; B05D 1/00

(52) U.S. Cl. ..... 8/142; 510/282; 510/285

(58) Field of Search ..... 510/286, 285, 510/291, 288, 289; 8/142, 111; 252/174.15, 174.17, 174.18, 174.19, 174.21, 174.23, 174.25, 174.12, 170, 172, 162

(56) References Cited

U.S. PATENT DOCUMENTS

| | | | | |
|---|---|---|---|---|
| 5,676,705 | * | 10/1997 | Jureller et al. | 8/142 |
| 5,683,473 | * | 11/1997 | Jureller et al. | 8/142 |
| 5,683,977 | * | 11/1997 | Jureller et al. | 510/286 |
| 5,712,237 | | 1/1998 | Stevens . | |
| 5,747,442 | | 5/1998 | Bory et al. . | |
| 5,820,637 | | 11/1998 | Bory et al. . | |
| 5,858,022 | * | 1/1999 | Romack et al. | 8/142 |
| 5,942,007 | | 8/1999 | Berndt et al. . | |
| 5,977,045 | * | 11/1999 | Murphy | 510/289 |
| 6,114,295 | * | 9/2000 | Murphy | 510/286 |

FOREIGN PATENT DOCUMENTS

| | | |
|---|---|---|
| 39 045 14 A1 | 8/1990 | (DE) . |
| 0 530 949 A1 | 3/1993 | (EP) . |
| 0 830 890 A1 | 3/1998 | (EP) . |
| 2 335 662 A | 9/1999 | (GB) . |
| 97/00990 | 1/1997 | (WO) . |
| 01/06053 | 1/2001 | (WO) . |

* cited by examiner

*Primary Examiner*—Yogendra N. Gupta
*Assistant Examiner*—Gregory E. Webb
(74) *Attorney, Agent, or Firm*—Edward A. Squillante, Jr.

(57) ABSTRACT

A novel cleaning composition for dry cleaning applications is described. The cleaning composition utilizes a stain removal composition having a stain removal surfactant and a stain removal solvent, and the dry cleaning applications use a solvent which is a gas at standard temperature and pressure, a biodegradable functionalized hydrocarbon or a silicone comprising solvent.

6 Claims, No Drawings

CLEANING COMPOSITION AND METHOD FOR USING THE SAME

FIELD OF THE INVENTION

This invention is directed to a novel cleaning composition and method for cleaning by using the same. More particularly, the invention is directed to a dry cleaning composition and a method for dry cleaning that employ a stain removal composition. The stain removal composition comprises a surfactant, and when contacted with a contaminated substrate, unexpectedly results in the elimination of substantially all contaminants without requiring the use of a displacing gas.

BACKGROUND OF THE INVENTION

In many cleaning applications, it is desirable to remove contaminants (e.g., stains) from substrates, like metal, ceramic, polymeric, composite, glass and textile comprising substrates. Particularly, it is highly desirable to remove contaminants from clothing whereby such contaminants include dirt, salts, food stains, oils, greases and the like.

Typically, dry cleaning systems use organic solvents, like chlorofluorocarbons, perchloroethylene, and branched hydrocarbons to remove contaminants from substrates. In response to environmental concerns, however, other dry cleaning systems have been developed that use inorganic solvents, such as densified carbon dioxide, to remove contaminants from substrates. The systems that use organic or inorganic solvents to remove contaminants from substrates generally employ a surfactant and a polar solvent so that a reverse-micelle may be formed to trap the contaminant targeted for removal.

Regardless of the type of solvents and surfactants employed, it is often very difficult to remove contaminants from substrates. This is true because contaminants often are chemically attracted to (e.g., dipole-dipole interactions, van der Waals forces) or become entangled with the substrate they are associated with. In fact, many known dry cleaning processes typically do not display superior cleaning results.

It is of increasing interest to develop compositions and methods that can be used to remove substantially all contaminants from substrates. This invention, therefore, is directed to a superior dry cleaning composition and method for dry cleaning that unexpectedly result in a substrate substantially free of contaminants (e.g., an SRI of at least about 64.0 as defined below) after cleaning and without the need to employ a displacing gas. Also, it is not required in this invention to use additives in the stain removal composition of the dry cleaning composition that are soluble in a continuous phase. Particularly, it is not required in this invention to employ a stain removal surfactant or an anti-redeposition agent, or both that is/are soluble in the continuous phase (as defined below).

BACKGROUND REFERENCES

Efforts have been disclosed for dry cleaning garments. In U.S. Pat. No. 5,683,977, a dry cleaning system using densified carbon dioxide and a surfactant adjunct is disclosed.

Other efforts have been disclosed for cleaning cloths. In U.S. Pat. No. 5,747,442, stick pretreater compositions containing hydrophobically modified polar polymers are disclosed whereby the stick pretreater compositions act as prewash stain removers in aqueous laundry systems.

Still further, other attempts have been made to clean fabrics. In U.S. Pat. No. 5,820,637, a method for pretreating fabrics with a composition substantially free of anionic surfactants is disclosed.

SUMMARY OF THE INVENTION

In a first embodiment, the present invention is directed to a stain removal composition for dry cleaning applications in a solvent that is a gas at standard temperature and pressure, a biodegradable functionalized hydrocarbon or a silicone comprising solvent wherein the stain removal composition comprises a stain removal surfactant.

In a second embodiment, the present invention is directed to a stain removal composition for dry cleaning applications in a solvent which is a gas at standard temperature and pressure, a biodegradable functionalized hydrocarbon or a silicone comprising solvent, the stain removal composition comprising:

(a) a stain removal surfactant; and (b) optionally, a stain removal solvent.

In a third embodiment, the present invention is directed to a dry cleaning composition comprising:

(a) at least one solvent selected from the group consisting of a solvent that is a gas at standard temperature and pressure, a biodegradable functionalized hydrocarbon or a silicone comprising solvent;

(b) optionally, a polar fluid;

(c) a substrate treated with a stain removal composition comprising at least one stain removal surfactant, the stain removal surfactant being a nonionic, anionic, cationic, amphoteric or zwitterionic compound or mixture thereof; and (d) optionally, a continuous phase surfactant, the continuous phase surfactant capable of forming a reverse micelle in a continuous phase formed by the solvent.

In a fourth embodiment, the present invention is directed to a process of dry cleaning in a solvent, which is a gas at standard temperature and pressure, a biodegradable functionalized hydrocarbon or a silicone comprising solvent, using the stain removing composition described above.

In a fifth embodiment, the present invention is directed to a substrate having been subjected to the dry cleaning process of this invention.

DETAILED DESCRIPTION OF THE PREFERRED EMBODIMENTS

There generally is no limitation with respect to the solvent (i.e., fluid) employed in this invention other than that the solvent is a gas at standard temperature and pressure, a biodegradable hydrocarbon or a silicone comprising solvent, and capable of being a continuous phase in a dry cleaning application. Illustrative examples of the types of solvents which may be employed in this invention include a $C_2$–$C_4$ substituted or unsubstituted alkane, carbon dioxide, silicone oil, and an azeotropic solvent.

Regarding the solvent which is a gas at standard temperature and pressure, such a solvent may be, within the dry cleaning composition or process, a gas, liquid or supercritical fluid depending upon how densified the solvent is (how much pressure is applied at a given temperature) in the domestic or commercial cleaning application the solvent is used in. Propane and carbon dioxide tend to be the preferred solvents when the solvent selected is one which is a gas at standard temperature and pressure. Carbon dioxide, however, is especially preferred.

As to the silicone comprising solvent which may be used in this invention, such a solvent is typically a commercially available cyclic-siloxane based solvent made available from GreenEarth Cleaning, LLC. Such a solvent is generally one which has a flash point over about 65° C., with octamethyl-cyclotetrasiloxane and decomethyl-cyclopentasiloxane being most preferred. A more detailed description of such conventional siloxane comprising solvents may be found in U.S. Pat. No. 5,942,007, the disclosure of which is incorporated herein by reference.

The biodegradable functionalized hydrocarbon that may be used in this invention includes those generally classified as an azeotropic solvent. Such an azeotropic solvent often comprises alkylene glycol alkyl ethers, like propylene glycol tertiary-butyl ether, and is described in U.S. Pat. No. 5,888,250, the disclosure of which is incorporated herein by reference. Moreover, as used herein, biodegradable functionalized hydrocarbon is defined to mean a biodegradable hydrocarbon comprising at least one member selected from the group consisting of an aldehyde, ketone, alcohol, alkoxy, ester, ether, amine, amide and sulfur comprising group.

Regarding the stain removal composition of this invention, such a composition comprises a stain removal surfactant that may generally be classified as a nonionic, anionic, cationic, amphoteric or zwitterionic compound. The stain removal surfactant which may be used in the stain removal composition of this invention is limited only to the extent that it minimizes the impact of the forces and interactions between the contaminant targeted for removal and the substrate. In addition to minimizing such forces and interactions, it is preferred that the surfactant employed in the stain removal composition is one that increases the solubility of the contaminant in the stain removal solvent being used, or suspends the contaminant in the stain removal solvent by forming lamellar micelles, or both.

Illustrative examples of the nonionic surfactants which may be used in this invention include fatty alcohol polyalkylene ethers resulting from condensation reactions, like fatty alcohol polyethylene glycol ethers and polyethylene/polypropylene (copolymer) glycol ethers. Such surfactants typically have an aliphatic portion comprising from about 8 to about 18 carbon atoms and about 2 to about 65 moles of alkoxylated portion per mole of aliphatic group. As to the alkoxylated portions, they are typically about 1:10 to about 10:1 ethylene oxide:propylene oxide when copolymers are employed. Other nonionic surfactants include ethylene oxide-propylene oxide block copolymers (weight average molecular weight of about 500 or more with ethylene oxide:propylene oxide portions being in a ratio of about 1:10 to about 10:1) and ($C_8$–$C_{18}$) fatty acid ($C_1$–$C_8$) alkanol amides like fatty acid ethanol amides.

Additional nonionic surfactants which may be used in the stain removal composition of this invention include N-alkylpyrrolidones, like N-octylpyrrolidone; polyalkylene oxide condensates of alkylphenols whereby the alkyl group has from about 5 to about 15 carbon atoms (straight or branched), the alkylene oxide preferably being ethylene oxide with from about 2 to about 65 moles of ethylene oxide per mole of alkyl phenol. The alkyl substituent is limited only to the extent that it does not interfere with the formation of the compound. Such a substituent is often derived from a $C_6$–$C_{14}$ alkane.

Still other examples of nonionic condensation products which may be used as the nonionic surfactants of this invention include the reaction product of $C_2$–$C_5$ diamines, like ethylene diamine, and excess $C_2$–$C_5$ alkylene alkylene oxide, like propylene oxide. Such products typically have a weight average molecular weight of about 500 to about 10,000, and they may be branched, linear, homopolymers, copolymers or terpolymers.

Nonionic tertiary phosphine oxides and long chain dialkyl sulfoxides may also be employed in the stain removal compositions of this invention, as well as nonionic surfactants generally classified as organosiloxanes. The organosiloxanes are often sold under the name Silwet® and made commercially available from the Witco Corporation. Such surfactants typically have an average weight molecular weight of about 350 to about 15,000, are hydrogen or $C_1$–$C_4$ alkyl capped and are hydrolyzable or non-hydrolyzable. Preferred organosiloxanes include those sold under the name of Silwet L-77, L-7602, L-7604 and L-7605, all of which are polyalkylene oxide modified dialkyl polysiloxanes.

Illustrative examples of the anionic surfactants that may be employed in this invention include ($C_8$–$C_{16}$) alkylbenzene sulfonates, ($C_8$–$C_{18}$) alkane sulfonates, ($C_8$–$C_{18}$) α-olefin sulfonates, α-sulfo ($C_8$–$C_{16}$) fatty acid methyl esters, ($C_8$–$C_{16}$) fatty alcohol sulfates, mono- and di- alkyl sulfosuccinates with each alkyl independently being a ($C_8$–$C_{16}$) alkyl group, alkyl ether sulfates, ($C_8$–$C_{16}$) salts of carboxylic acids and isethionates having a fatty chain of about 8 to about 18 carbons.

The cationic surfactants which may be used in this invention include those comprising amino or quarternary ammonium hydrophilic moieties that possess a positive charge in an aqueous solution. An illustrative list of the cationic surfactants that may be used in this invention includes cetyl trimethyl ammonium bromide, dodecyl trimethyl ammonium chloride, ditallow diimethyl ammonium chloride, ditallow dimethyl ammonium methyl sulfate, dihexadecyl dimethyl ammonium chloride and the like, including any other commercially available salt of a primary, secondary or tertiary fatty amine. Other cationic surfactants include amine oxides like lauryl and stearyl amine oxide.

As to the amphoteric surfactants which may be used in this invention, such surfactants include alkyl betaines and those broadly described as derivatives of aliphatic quarternary ammonium, phosphonium and sulfonium compounds whereby the aliphatic radical can be straight or branched with one of the aliphatic substituents containing from about 8 to about 18 carbon atoms and one containing an anionic water solubilizing group such as a carboxy, sulfonate, sulfate, phosphate or phosphonate group.

The zwitterionic surfactants that may be used in this invention include those which may be broadly classified as derivatives of aliphatic quaternary ammonium, phosphonium and sulfonium compounds wherein the aliphatic radicals can be straight or branched with one of the aliphatic substituents containing from about 8 to about 18 carbons and one containing an anionic group such as a carboxy, sulfonate, sulfate, phosphate or phosphonate group.

The most preferred stain removal surfactants used in this invention are Silwet L-77 or L-7602 when organosiloxanes are desired; ethoxylates, like Neodol 25-9 (commercially available from Shell Chemical) when nonionic alkoxylate comprising compounds are desired, or N-octylpyrrolidone when a nonionic, non-silicone non-alkoxylated comprising surfactant is desired; sodium diethylhexyl sulfosuccinate, or sodium methyl benzene sulfonate when an anionic surfactant is desired. Moreover, it is within the scope of this invention to employ mixtures of the stain removal surfactants described.

A more detailed description of the types of stain removal surfactants which may be used in this invention may be found in Surfactants in Consumer Products—Theory, Technology and Application, Ed. J. Falbe, published by Spinger-Verlag, 1987; McCutcheon's, Emulsifiers and Detergents, 1999 Annual, published by M.C. Publishing Co., U.S. Pat. No. 5,120,532 and WO Patent No. 98/56890, all of which are incorporated herein by reference.

The amount of stain removal surfactant that may be employed in the stain removal composition of this invention is typically from about 0.1% to about 100%, and preferably, from about 0.5% to about 50%, and most preferably from about 5.0% to about 20% by weight, based on total weight of the stain removal composition, including all ranges subsumed therein.

Regarding the stain removal solvent which may optionally (but preferably) be used in this invention, the solvent is often selected from the group consisting of acetates, alcohols, esters, glycols, glycol ethers, $D_3$–$D_8$ siloxanes, water and mixtures thereof. The preferred alcohols are typically $C_1$–$C_3$ alkanols (e.g., ethanol) and the preferred acetates are triacetates (e.g., glycerol triacetate). When desired, the total amount of solvent used in the stain removal composition of this invention is from about 0.0% to about 99.9%, and preferably, from about 5.0% to about 80%, and most preferably, from about 10.0% to abut 75% by weight, based on total weight of the stain removal composition, including all ranges subsumed therein.

An optional additive which may be employed in the stain removal composition includes an enzyme, and particularly, one generally classified as a protease, lipase or amylase type enzyme.

Such enzymes are normally incorporated at levels sufficient to provide up to about 10 mg, and preferably, from about 0.001 mg to about 6 mg, and most preferably, from about 0.002 mg to about 2 mg by weight of active enzyme per gram of the aqueous compositions. Stated otherwise, the stain removal composition of this invention can comprise from about 0.0001% to about 1.0%, preferably from about 0.001% to about 0.6%, more preferably from about 0.005% to about 0.4% by weight of a commercial enzyme preparation. Protease enzymes are usually present in such commercial preparations at levels sufficient to provide from 0.0005 to 0.2 Anson units (AU) of activity per gram of stain removal composition.

Non-limiting examples of suitable, commercially available, proteases that may be used include pepsin, tripsin, ficin, bromelin, papain, rennin, and mixtures thereof. Other suitable examples of proteases are the subtilisins which are obtained from particular strains of *B. subtilis* and *B. licheniforms.* Another suitable protease is obtained from a strain of *bacillus,* having maximum activity throughout the pH range of 8–12, developed and sold by Novo Industries A/S under the registered trade name ESPERASE®. The preparation of this enzyme and analogous enzymes is described in British Patent Specification No. 1,243,784. Still other enzymes include Protease A (European Patent Application 130,756, published Jan. 9, 1985); Protease B (European patent Application Serial No. 87303761.8, filed Apr. 28, 1987, and European Patent Application 130,756, Bot et al., published Jan. 9, 1985); and proteases made by Genencor International, Inc., according to one or more of the following patents: Caldwell et al., U.S. Pat. Nos. 5,185,258, 5,204,015 and 5,244,791, all of which are incorporated herein by reference. Other enzymes suitable for removing protein-based stains that are commercially available include those sold under the trade names ALCALASE® and SAVINASE® by Novo Industries A/S (Denmark) and MAXATASE® by International Bio-synthetics, Inc. (The Netherlands).

A wide range of enzyme materials and means for their incorporation into compositions are also disclosed in U.S. Pat. No. 3,553,139, issued Jan. 5, 1971 to McCarty et al. Enzymes are further disclosed in U.S. Pat. No. 4,101,457, to Place et al., issued Jul. 18, 1978, and in U.S. Pat. No. 4,507,219, to Hughes issued Mar. 26, 1985, whereby all of the above are incorporated herein by reference.

As to the lipase which may be employed in this invention, such enzymes are well known and commercially available, and are produced, for example, by microorganisms of the Pseudomonas group, such as *Pseudomones stutzeri* ATCC 19.154, as described in British Patent 1,372,034, the disclosure of which is incorporated herein by reference. Another lipase which may be used is the D96L lipase enzyme derived from *Humicol lanuginosa* as described in U.S. Pat. No. 5,929,022, the disclosure of which is incorporated herein by reference.

Regarding the amylase which may be employed in this invention, such enzymes are well known and commercially available. They include α-amylase obtained from, for example, *B. licheniformis* (from Novo), as well as those sold under the name of Rapidase (by Gist-Brocades) and Termamyl and BAN (by Novo).

Still other additives which may optionally be employed in the stain removal composition of this invention include anti-redeposition agents, builders, chelators, fragrances, hydrotropes, enzyme stabilizers, bleaches, fluorescers mixtures thereof and the like, all of which are known compounds and commercially available.

The anti-redeposition agents which may be used include, for example, cellulosic polymers and salts like sodium sulphate as well as copolymers derived from acrylic acid and lauryl methacrylate, like Narlex DC-1, made available by National Starch and Chemical. Others include polycarboxylic acids such as those sold under the name of Alcosperse 725 and made commercially available by Alco. The builders (sequesters) which may be used include citrates like sodium citrate, and phosphates like sodium tripolyphospoate. The chelators which may be used are those which are well know in the art and they typically include ethylene diamine tetracetic acid as well as nitrilotriacetic acid. The fragrances which may be used in the stain removal compositions of this invention include those conventionally used in cleaning compositions and made commercially available by, for example, Bush Booke Allen, Inc. and Quest International. The hydrotropes which may be used in this invention are known in the art and include sodium xylene sulfonate, sodium cumene sulfonate, ethanol, urea or mixtures thereof. Regarding the enzyme stabilizers which may be used in this invention, such stabilizers are often selected from the group consisting of glycerol sorbitol, berate oxide, borax, alkali metal borates, and preferably, boric acid.

The bleaches which may be used in this invention include hydrogen peroxide, chlorine dioxide, tetracetylethylene diamine, mixtures thereof and the like. The fluorescers which may be used in this invention include those generally classified as stilbenes, oxazoles, benzoxazoles, benzidimazoles and the like. Preferred fluorescers are made available under the name of Tinopal (Ciba Geigy) and Optiblanc (3V, Inc.).

The amount of optional additives employed in the stain removal composition of this invention is limited only to the extent the amount used does not prevent the stain removal composition from minimizing the impact of the forces and interactions between the contaminant targeted for removal and the substrate. Typically, however, the total amount of optional additive used in the stain removal composition of this invention is from about 0.0% to about 15%, and preferably, from about 0.1% to about 12%, and most preferably, from about 1.0% to about 10% by weight, based on total weight of the stain removal composition, including all ranges subsumed therein.

When preparing the stain removal composition of this invention, there is no limitation with respect to the processing steps as long as the resulting composition is one which may be used in a cleaning application. Essentially, the components (e.g., stain removal surfactant, solvent) of the stain removal composition are, for example, mixed, stirred or agitated using any art recognized technique. The stain removal compositions may be made at ambient temperature, atmospheric pressure or at any pressure or temperature variations which may result in a stain removal composition. The addition of such components is not limited to any particular order, with the proviso that the resulting composition is one which may be employed in a cleaning application.

When applying the stain removal composition to the substrate with the contaminant targeted for removal, there is no limitation with respect to how the stain removal composition is applied as long as the composition contacts the contaminant. Often, the stain removal composition is applied via a rag, a brush, by dipping the contaminated substrate into the stain removal composition, an aerosol applicator or a trigger spray bottle. The preferred way to apply the stain removal composition is, however, with a conventional trigger spray bottle. Moreover, the amount of stain removal composition employed is typically enough to cover the contaminant targeted for removal.

Subsequent to subjecting the contaminated substrate to the stain removal composition, the contaminated substrate may be cleaned with a machine having the capacity to clean contaminated substrates with a solvent that is a gas at standard temperature and pressure, a biodegradable functionalized hydrocarbon or a silicone comprising solvent.

When the solvent employed is a gas at standard temperature and pressure, like propane or carbon dioxide, the machine which is employed for cleaning is well known in the art. Such a machine typically comprises a gas supply, cleaning tank and condenser. The machine may further comprise a means for agitation; particularly, when the contaminated substrate targeted for removal is a fabric. The means for agitation may be, for example, a mechanical device like a mechanical tumbler, or a gas-jet agitator. The art recognized machines which may be used in this invention (e.g., when solvent which is a gas at STP is used) may be found in U.S. Pat. Nos. 5,943,721, 5,925,192, 5,904,737, 5,412,958, 5,267,455 and 4,012,194, the disclosures of which are incorporated herein by reference.

When the solvent employed in this invention is a biodegradable functionalized hydrocarbon or a silicone comprising solvent, the machine employed may be the same or substantially the same as any of the commonly used machines used for dry cleaning with perchloroethylene. Such machines typically comprise a solvent tank or feed, a cleaning tank, distillation tanks, a filter and solvent exit. These commonly used machines are described, for example, in U.S. Pat. No. 4,712,392, the disclosure of which is incorporated herein by reference.

Once the substrate being cleaned is inserted in or subjected to the machine employed for cleaning, the ordinary cleaning cycle is run (typically between about three (3) minutes to about one (1) hour) and the substrate is cleaned. Thus, to demonstrate cleaning, it is not required to add anything to the cleaning machine other than the substrate comprising the contaminant targeted for removal (having the stain removal composition applied thereon) and the solvent that is a gas at standard temperature and pressure, a biodegradable functionalized hydrocarbon or a silicone comprising solvent.

In a preferred embodiment, however, a polar solvent, such as water, is employed along with a continuous phase surfactant that is capable of forming a reverse micelle in a continuous phase formed by the solvent. When a polar solvent and a continuous phase surfactant are employed, the amount of polar solvent used is typically about 0.5 to about 8 times, and preferably, from about 1 to about 5 times; most preferably, from about 1.5 to about 2.5 times the amount of continuous phase surfactant employed in the dry-cleaning composition.

The amount of continuous phase surfactant used in the dry-cleaning composition is typically between about 0.01 to about 2.0 wt. %; and preferably, from about 0.02 to about 1.0 wt. %; most preferably, from about 0.03 to about 0.8 wt. % continuous phase surfactant, based on total volume of the dry-cleaning composition, including all ranges subsumed therein.

When the solvent employed is a gas at standard temperature and pressure or a silicone comprising surfactant, the continuous phase surfactant is typically any surfactant that comprises a group having an affinity for the polar solvent and a group having an affinity for the continuous phase surfactant. Such a continuous phase surfactant may comprise sodium bis(2-ethylhexyl) sulfosuccinate [Aerosol OT or AOT], made commercially available from Aldrich. When AOT is employed, it is preferred that the solvent is a $C_2$–$C_4$ substituted or unsubstituted alkane, preferably propane. Other continuous phase surfactants which may be used include didodecyl dimethyl ammonium bromide, polyoxyethylene ethers (e.g., Brij 30, Brij 52) and lecithin. Such continuous phase surfactants are described in U.S. Pat. Nos. 5,158,704 and 5,266,205, the disclosures of which are incorporated herein by reference.

Additional continuous phase surfactants which may be used in this invention include end-functionalized polysiloxanes. Such end-functionalized polysiloxanes are represented in general, by the formula $B_1$—A—$B_2$ wherein $B_1$ and $B_2$ are each independently an end-functional group and A is a polysiloxane such as polydimethysiloxane (having an average weight molecular weight of about 75 to about 400,000.

The end-functionalized polysiloxanes typically are represented by the formula:

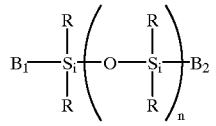

wherein n is an integer from about 1 to about 10,000, preferably from about 1 to about 100.

At least one and preferably, both of $B_1$ and $B_2$ are solvent phobic groups such as lipophilic or hydrophilic (e.g., anionic, cationic) groups, but are not $CO_2$-philic groups. Each R is independently an alkyl, aryl or haloalkyl, with perfluoroalkyl, $C_1$–$C_4$ alkyls, phenyl and trifluoropropyl being the preferred R groups.

Regarding $B_1$ and $B_2$, such end-functional groups may be derived from silicones with reactive groups that yield end-functional materials upon contact with a substrate. Illustrative examples of such reactive groups include vinyl, hydride, silanol, alkozy/polymeric alkoxide, amine, epoxy, carbinol, methacrylate/acrylate, mercapto, acetoxy/chlorine/dimethylamine moieties.

A more detailed description of the types of end-functionalized polysiloxanes which may be used in this invention may be found in WO 99/10587, the disclosure of which is incorporated herein by reference.

Other continuous phase surfactants which may be employed in this invention include those generally classified as acetylenic alcohols or diols as represented by the formulae below, respectively:

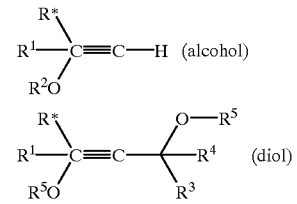

wherein $R^*$, $R^1$, $R^3$ and $R^4$ are each independently hydrogen atoms or linear or branched alkyl groups comprised of 1 to 38 carbons, and $R^2$ and $R^5$ are each hydrogen atoms or hydroxyl terminated polyalkylene oxide chains derived from 1 to 30 alkylene oxide monomer units of the following structure:

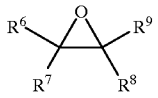

wherein $R^6$, $R^7$, $R^8$ and $R^9$ are each independently hydrogen atoms, linear or branched alkyl groups having about 1 to about 5 carbons, or phenyl.

Still other continuous phase surfactants which may been employed in this invention include alkoxylated fatty alcohols having, for example, ethoxy or ethoxy and propoxy in a ratio of about 2:1 and an aliphatic chain comprising from about 8 to about 15 carbon atoms. These types of surfactants are most often preferred when the solvent employed is a biodegradable functionalized hydrocarbon.

The most preferred and the superior continuous phase surfactants which may be used in this invention include those having the formula:

$$MD_xD^*_yM$$

wherein M is a tialkylsiloxyl end group, $D_x$ is a dialkylsiloxyl backbone which is solvent-philic and $D^*_y$ is one or more alkylsiloxyl groups which are substituted with a solvent-phobic group wherein each solvent phobic group is independently defined by the formula:

$$(CH_2)_a(C_6H_4)_b(A)_d—[(L)_e—(A')_f—]_n—(L')_gZ(G)_h$$

wherein a is 1–30, b is 0 or 1, $C_6H_4$ is unstubstituted or substituted with a $C_{1-10}$ alkyl or alkenyl, and A and A' are each independently a linking moiety representing an ester, a keto, an ether, a thio, an amido, an amino, a $C_{1-4}$ fluoroalkyl, a $C_{1-4}$ fluoroalkenyl, a branched or straight chained polyalkylene oxide, a phosphate, a sulfonyl, a sulfate, an ammonium, and mixtures thereof, L and L' are each independently a $C_{1-30}$ straight chained or branched alkyl or alkenyl or an aryl which is unsubstituted or substituted, e is 0–3 f is 0 or 1 n is 0–10 g is 0–3 d is 0–5,

Z is a hydrogen, carboxylic acid, a hydroxy, a phosphate, a phosphate ester, a sulfonyl, a sulfonate, a sulfate, a branched or straight-chained polyalkylene oxide, a nitryl, a glyceryl, an aryl unsubstituted or substituted with a $C_{1-30}$ alkyl or alkenyl, a carbohydrate unsubstituted or substituted with a $C_{1-10}$ alkyl or alkenyl or an ammonium, G is an anion or cation such as $H^+$, $Na^+$, $Li^+$, $K^+$, $NH_4^+$, $Ca^{+2}$, $Mg^{+2}$, $Cl^-$, $Br^-$, $I^-$, mesylate, or tosylate, and h is 0–3.

Such surfactants are described in U.S. Pat. Nos. 5,676,705, 5,683,977, 5,683,473, commonly assigned to Lever Brothers Company, a Division of Conopco, Inc., the disclosures of which are incorporated herein by reference.

When performing the actual cleaning of the contaminated substrate, it is most preferred in this invention for the substrate to be a fabric such as clothing and the solvent to be densified carbon dioxide wherein the continuous phase surfactant is polyorganosiloxane derived. Typically, when the cleaning process takes place, the carbon dioxide is maintained at a temperature from about 1.0 to about 25° C., and preferably, from about 5.0 to about 20.0° C., and most preferably, from about 8.0° C. to about 15° C., including all ranges subsumed therein. Moreover, when carbon dioxide is used, it is typically maintained at a pressure from about 775 to about 2,000 psi, and preferably from about 800 to about 1,300 psi, and most preferably, from about 825 to about 875 psi, including all ranges subsumed therein.

It is also noted herein that optional additives may be employed in the solvent (e.g., the solvent that is a gas at standard temperature and pressure). Such optional additives include an oxidizing agent, like hydrogen peroxide, and an organic bleach activator, like those represented by the formula:

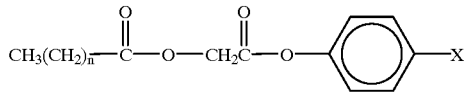

wherein n is an integer from about 0–20 and X is hydrogen or $SO_3M$ and M is hydrogen, an alkali metal or an ammonium cation. A more detailed description of such additives may be found in U.S. Pat. No. 5,431,843, the disclosure of which is incorporated herein by reference.

Other optional additives that may be employed in the solvent used in this invention include antistatic agents and deodorizing agents. Such antistatic agents typically include $C_8$–$C_{12}$ alcohol ethoxylates, $C_8$–$C_{12}$ alkylene glycols and glycol esters. The deodorizing agents, on the otherhand, typically include fragrances such as those described in U.S. Pat. No. 5,784,905, the disclosure of which is incorporated herein by reference.

Still other optional additives include viscosity modifiers like propylene glycol and sodium xylene sulfonate.

As to the amount of optional additives used in the solvent, such an amount is limited only to the extent that the additive does not interfere with the cleaning process.

The examples below are provided for illustrative purposes, and they are not intended to restrict the scope of the invention. Thus, various changes may be made to the specific embodiments of this invention without departing from its spirit. Accordingly, the invention is not to be limited to the precise embodiments shown and described, but only as indicated in the following claims.

Stain removal (extent cleaning) was measured with a Hunter Ultrascan XE Spectrophotometer. The L, a, b scale was used to measure cleaning, and the results are reported as a stain removal index value (SRI) by using the following formula:

$$SRI = 100 - \left( \left( L_{washed} - L_{clean} \right)^2 + \left( a_{washed} - a_{clean} \right)^2 + \left( b_{washed} - b_{clean} \right)^2 \right)^{1/2}$$

wherein

L measures black to white differences;

a measures green to red differences; and b measures blue to yellow differences.

Least Significant Difference stain removal index values for all comparisons were calculated using the method described in Statistical Principles of Research Design and Analysis, Duxbury Press, by Robert O. Kuehl, (1994). The values below are based on four (4) observations for each group investigated.

EXAMPLE 1

Swatches of cotton cloth, about 22 cm×13 cm, were inscribed in pencil, with a circle having a diameter of about 5 cm. Six hundred (600) microliters of coffee (prepared by adding about 9 tablespoons of coffee and 2.5 cups of water to an automatic drip coffee maker) were applied inside the circles of the swatches after cooling. The cooled coffee was applied via a micropipet and the resulting stained swatches were dried overnight.

EXAMPLE 2

Four swatches (prepared in Example 1) were placed in a cleaning chamber of a dry cleaning unit suitable for cleaning with carbon dioxide. The dry cleaning unit was constructed in the manner described in U.S. Pat. No. 5,467,492. The cleaning chamber was also charged with 11 pounds of cotton sheets (about 28 $cm^2$) to simulate a full load of laundry. Carbon dioxide was circulated in the machine at a rate of about 490 liters of liquid $CO_2$ per cleaning loop, and a storage tank was employed to feed the unit with clean carbon dioxide. The cleaning cycle lasted for about 15 minutes and the carbon dioxide was pressurized to about 850 psi at 11° C. Subsequent to the cleaning cycle, the liquefied $CO_2$ was circulated back to the storage tank and the swatches were removed. The SRI calculated by averaging the SRI for each of the four (4) swatches was 70.5.

EXAMPLE 3

The experiment of Example 3 was conducted in a manner similar to the experiment described in Example 2 except that the carbon dioxide solvent was charged with 0.05% (weight/volume) organosilicone surfactant (Monasil PCA, commercially available from Mona Industries) and 0.050% (weight/volume) water. Also, the four (4) swatches in this example were subjected to the stain removal composition of this invention having ethoxylated polyorganosiloxane (Silwet L-7602), (10.0%); ethanol (10.0%); glycerol triacetate (8.0%); N-octylpyrrolidone (2.0%); Narlex DC-1 anti-redeposition polymer (1.0%) and a balance of water, wherein all percents are by weight based on total weight of the stain removal composition. The spray spotter was applied via a trigger spray bottle (i.e., about 4 full and quick pulls of the trigger with the nozzle of the spray bottle being about 8 inches away from each stained swatch.) The SRI calculated by averaging the SRI for each of the 4 swatches was 84.7.

EXAMPLE 4

The experiment of Example 4 was conducted in a manner similar to the experiment described in Example 3 except that no stain removal composition was used. The SRI calculated by averaging the SRI for each of the 4 swatches was 71.4.

EXAMPLE 5

The experiment of Example 5 was conducted in a manner similar to the experiment conducted in Example 3 except that Monasil PCA was replaced with an EO/PO/EO block copolymer (commercially available from BASF and sold under the name Pluronic L-62) and the swatches were stained with 350 microliters of grape juice (which was prepared by diluting concentrated grape juice with water [1:4 weight ratio]) in lieu of coffee. The SRI calculated by averaging the SRI for each of the four (4) swatches was 84.5.

EXAMPLE 6

The experiment of Example 6 was conducted in a manner similar to the experiment conducted in Example 5 except that no stain removal composition was used. The SRI calculated by averaging the SRI for each of the 4 swatches was 76.0.

EXAMPLE 7

The experiment of Example 7 was conducted in a manner similar to the experiment conducted in Example 2 except that the swatches were stained with grape juice (in a manner described in Example 5) in lieu of coffee as described in Example 1. The SRI calculated by averaging the SRI for each of the 4 swatches was 65.5.

EXAMPLE 8

The experiment of Example 8 was conducted in a manner similar to the experiment conducted in Example 3 except that the swatches were silk and stained with 300 microliters of cow blood (which was obtained from a commercial butcher shop) in lieu of coffee. The SRI calculated by averaging the SRI for each of the 4 swatches was 64.0.

EXAMPLE 9

The experiment of Example 9 was conducted in a manner similar to the experiment conducted in Example 8 except that no stain removal composition was used. The SRI calculated by averaging the SRI for each of the 4 swatches was 62.7.

EXAMPLE 10

The experiment of Example 10 was conducted in a manner similar to the experiment conducted in Example 2 except that cow blood was employed in lieu of coffee. The SRI calculated by averaging the SRI for each of the 4 swatches was 62.0.

EXAMPLE 11

The experiment of Example 11 was conducted in a manner similar to the experiment conducted in Example 3 except that the swatches were stained with 250 microliters of shoe polish solution ( which was prepared by diluting commercially available shoe polish 1 to 15 with water) in lieu of coffee. Also, Monasil PCA was replaced by an EO/PO/EO block polymer (commercially available from BASF and sold under the name of Pluronic L-62). The SRI calculated by averaging the SRI for each of the 4 swatches was 77.7.

EXAMPLE 12

The experiment of Example 12 was conducted in a manner similar to the experiment conducted in Example 11 except that no stain removal composition was employed. The SRI calculated by averaging the SRI for each of the 4 swatches was 75.0.

EXAMPLE 13

The experiment of Example 13 was conducted in a manner similar to the experiment conducted in Example 2 except that the swatches were stained with shoe polish in lieu of coffee. The SRI calculated by averaging the SRI for each of the 4 swatches was 74.9.

EXAMPLE 14

The experiment of Example 14 was conducted in a manner similar to the one described in Example 8 except that the swatches were cotton and the stain removal composition consisted of 90% by weight water and 10% by weight Silwet L-7602. The SRI calculated by averaging the SRI of the 4 swatches was 70.9.

EXAMPLE 15

The experiment of Example 15 was conducted in a manner similar to the one described in Example 14 except that no stain removal composition was used. The SRI calculated by averaging the SRI of the 4 swatches was 59.3.

EXAMPLE 16

The experiment of Example 16 was conducted in a manner similar to the one described in Example 2 except that the cow blood was used in lieu of coffee. The SRI calculated by averaging the SRI of the 4 swatches was 58.9.

EXAMPLE 17

The experiment of Example 17 was conducted in a manner similar to the one described in Example 3 except that the stain removal composition comprised Silwet L-77 (1.0%); Neodol 25-9 (10.0%); propylene glycol (1.0%); Alcosperse 725 (1.0%) and a balance of water. Also, in lieu of Monasil PCA, 0.128% (w/v) of a detergent consisting of Silwet L-7602, water and propylene glycol (40%, 40%, 20% by weight, respectively) was used, and commercially available swatches (e.g., from Kraefeld of Germany) stained with coffee, blood or red wine were used. The data in Table I depicts the % stain removal obtained when using the stain removal composition of Example 17.

TABLE I

| | % Soil Removal | | |
|---|---|---|---|
| Swatch stain | A | B | C |
| Coffee | −0.4 | −4.0 | 7.0 |
| Blood | 3.5 | 3.6 | 15.2 |
| Red Wine | −0.1 | −0.2 | 8.5 |

A = pure Carbon Dioxide
B = as described in Exampte 17, except no stain removal composition used
C = as described in Example 17

$$\%\ \text{soil removal} = \frac{\text{stain removed}}{\text{stain applied}} = \left(\frac{\text{cleaned cloth reading} - \text{stained cloth reading}}{\text{unstained cloth reading} - \text{stained cloth reading}}\right) \times 100$$

The data in Table II depicts the LSD values for the group wise comparisons.

TABLE II

| Groups (Examples) | LSD Value |
|---|---|
| 2, 3, 4 | 2.7 |
| 5, 6, 7 | 1.2 |
| 8, 9, 10 | 0.5 |
| 11, 12, 13 | 1.2 |
| 14, 15, 16 | 1.2 |

The results obtained via the experiments demonstrate that the inventions described herein unexpectedly result in a substrate substantially free of contaminants, without requiring the use of a displacing gas, and without requiring a stain removal surfactant soluble in a continuous phase solvent or an anti-redeposition agent soluble in a continuous phase solvent, or both.

Moreover, it was also unexpectedly discovered that none of the swatches cleaned via this invention showed signs of residue or film after visual and physical examinations. This was true, for example, even when an anti-redeposition agent and/or a stain removal surfactant was used that were/was not soluble in the continuous phase.

What is claimed is:

1. A process for removing a contaminant from a substrate comprising the steps of:

(a) contacting a substrate comprising a contaminant with a stain removal composition to produce a substrate comprising a stain removal composition;

(b) subjecting the substrate comprising a stain removal composition to a solvent that is a gas at standard temperature and pressure, a biodegradable functionalized hydrocarbon or a silicone comprising solvent; and (c) dry cleaning the substrate.

2. A process according to claim 1 wherein the solvent comprises a polar solvent and a continuous phase surfactant.

3. A process according to claim 2 wherein the polar solvent is water and the continuous phase surfactant is aerosol OT, didodecyl dimethylammonium bromide, polyoxyethylene ether, lecithin, end-functionalized polysiloxane, an acetylenic alcohol, a acetylenic diol, an alkoxylated fatty alcohol, or a siloxane having the formula:

$$MD_xD^*_yM$$

wherein M is a tialkylsiloxyl end group, $D_x$ is a dialkylsiloxyl backbone which is solvent-philic and $D^*_y$ is one or more alkylsiloxyl groups which are substituted with a solvent-phobic group wherein each solvent phobic group is independently defined by the formula:

$$(CH_2)_a(C_6H_4)_b(A)_d—[(L)_e—(A')_f—]_n—(L')_gZ(G)_h$$

wherein a is 1–30, b is 0 or 1, $C_6H_4$ is unsubstituted or substituted with a $C_{1-10}$ alkyl or alkenyl, and A and A' are each independently a linking moiety representing an ester, a keto, an ether, a thio, an amido, an amino, a $C_{1-4}$ fluoroalkyl, a $C_{1-4}$ fluoroalkenyl, a branched or straight chained polyalkylene oxide, a phosphate, a sulfonyl, a sulfate, an ammonium, and mixtures thereof, L and L' are each independently a $C_{1-30}$ straight chained or branched alkyl or alkenyl or an aryl which is unsubstituted or substituted, E is 0–3, F is 0 or 1, N is 0–10, G is 0–3, O is 0–5, Z is a hydrogen, carboxylic acid, a hydroxy, a phosphato, a phosphate ester, a sulfonyl, a sulfonate, a sulfate, a branched or straight-chained polyalkylene oxide, a nitryl, a glyceryl, an aryl unsubstituted or substituted with a $C_{1-30}$ alkyl or alkenyl, a carbohydrate unsubstituted or substituted with a $C_{1-10}$ alkyl or alkenyl or an ammonium, G is an anion or cation such as $H^+$, $Na^+$, $Li^+$, $K^+$, $NH_4^+$, $Ca^{+2}$, $Mg^{+2}$, $Cl^-$, $Br^-$, $I^-$, mesylate, or tosylate, and h is 0–3.

4. A process according to claim 1 wherein the solvent is carbon dioxide.

5. A process according to claim 1 wherein the stain removal composition comprises a stain removal surfactant selected from the group consisting of an organosiloxane, an alkoxylate, N-octylpyrrolidone, sodium diethylhexyl sulfosuccinate, sodium methyl benzene sulfonate or mixtures thereof.

6. A process according to claim 1 wherein the substrate is clothing.

* * * * *